US007518072B2

(12) United States Patent
Yoda

(10) Patent No.: US 7,518,072 B2
(45) Date of Patent: Apr. 14, 2009

(54) LATCH RELEASING DEVICE

(75) Inventor: Yuji Yoda, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 247 days.

(21) Appl. No.: 11/540,750

(22) Filed: Oct. 2, 2006

(65) Prior Publication Data

US 2007/0163864 A1 Jul. 19, 2007

(30) Foreign Application Priority Data

Jan. 13, 2006 (JP) ..... 2006-006015

(51) Int. Cl.
*H01H 9/06* (2006.01)

(52) U.S. Cl. ..... 200/61.62; 200/520

(58) Field of Classification Search ... 200/61.62–61.85, 200/61.4, 341, 520–572, 332.2
See application file for complete search history.

(56) References Cited

U.S. PATENT DOCUMENTS 4,063,054 A * 12/1977 Hirata ..... 200/1 B
5,396,038 A * 3/1995 Yamada ..... 200/517
7,057,124 B2 * 6/2006 Ieda et al. ..... 200/61.62
7,273,991 B2 * 9/2007 Korultay et al. ..... 200/61.62
2004/0262139 A1 * 12/2004 Ieda et al. ..... 200/341

FOREIGN PATENT DOCUMENTS

JP 3534068 3/2004
JP 2004-324098 11/2004

OTHER PUBLICATIONS

Korean Office Action issued in Patent Application No. 10-2008-0050126 dated on Aug. 29, 2008.

* cited by examiner

*Primary Examiner*—Elvin G Enad
*Assistant Examiner*—Marina Fishman
(74) *Attorney, Agent, or Firm*—McDermott Will & Emery LLP

(57) ABSTRACT

A latch releasing device includes a switch that is turned on upon pressing a pressing button towards a switch body and unlatches a door, a base member that holds the switch via the switch body such that the pressing button is arranged on a front surface thereof, a key top member on the base member to cover the pressing button of the switch, and a biasing member between the base member and the key top member that biases the key top member in a direction departing from the pressing button of the switch. The switch is fixed to a panel via the base member such that the pressing button can be pressed via the key top member from outside the panel.

5 Claims, 10 Drawing Sheets

LATCH RELEASING DEVICE

BACKGROUND OF THE INVENTION

1. Field of the Invention

The present invention relates to a device that releases a latched condition of a door.

2. Description of the Related Art

Recently, in a vehicle, a release actuator is driven to unlatch a door such as a trunk lid. A latch releasing device applied to such a vehicle generally includes a switch for driving the release actuator. Such a latch releasing device is disclosed in for example, Japanese Patent No. 3534068, in which an operating unit that projects outwards from an opening of a door outer panel axially supports a door handle on a base member. A switch that is more medially located than the door outer panel is turned on by a pressing portion of the door handle when the operating unit is swung.

In the vehicle with the latch releasing device, when an operator swings the operating unit of the door handle to turn on the switch, the release actuator is driven to cause a door latch device to unlatch the door. Thus, compared to a conventional latch releasing device that releases the door latch via a wire cable or a link rod, a control force can be significantly reduced.

In the latch releasing device, the operating unit of the door handle and a load receiving member that receives an operation load for door-opening operation are covered by a waterproof cover. The periphery of the cover is sandwiched between the door outer panel and the base member to ensure desired waterproof performance. Thus, for example, in vehicle washing, washing water can be prevented from entering inside from the opening of the outer door panel.

However, for example, if washing water having a high pressure is sprayed on the cover member at a car washing station, the door handle may swing via the cover member. This causes the switch to turn on, and the trunk lid is accidentally opened. Setting a high spring constant of a return spring inside the switch can prevent such a situation. However, a high spring constant of the return spring causes defects, for example, that the switch is not turned on by operating the operating unit, and the operability is significantly reduced.

SUMMARY OF THE INVENTION

It is an object of the present invention to at least partially solve the problems in the conventional technology.

According to an aspect of the present invention, a latch releasing device configured to latch or unlatch a door, includes a switch that turns on when pressed to unlatch the door, a base member that holds the switch on a surface thereof, a key top member that at least partially encloses the switch, and a biasing member that biases the key top member in a direction departing from the switch. The switch is fixed to a panel via the base member such that the switch can be pressed from outside the panel via the key top member.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 14B is a cross section of the latch releasing device when the switch is on.

DETAILED DESCRIPTION OF THE PREFERRED EMBODIMENTS

Exemplary embodiments of the present invention are explained below with reference to the accompanying drawings.

FIGS. 1 to 9 depict a latch releasing device according to an embodiment of the present invention. The latch releasing device is arranged on a trunk lid that is a door for opening and closing a trunk of a vehicle such as a four-wheeled car. The latch releasing device operates to release a latched condition of the trunk lid. The latch releasing device includes a switch 10 and a base member 20.

Figure 2A:
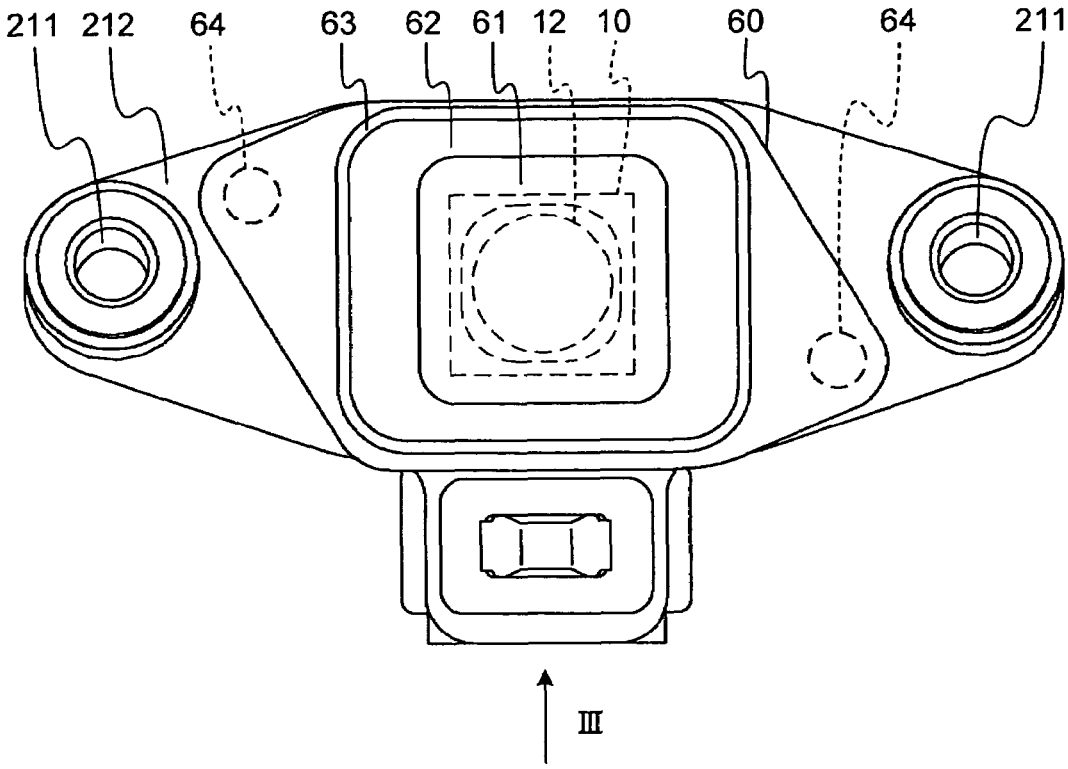
FIG. 2A is a plan view of the latch releasing device.
Figure 2B:
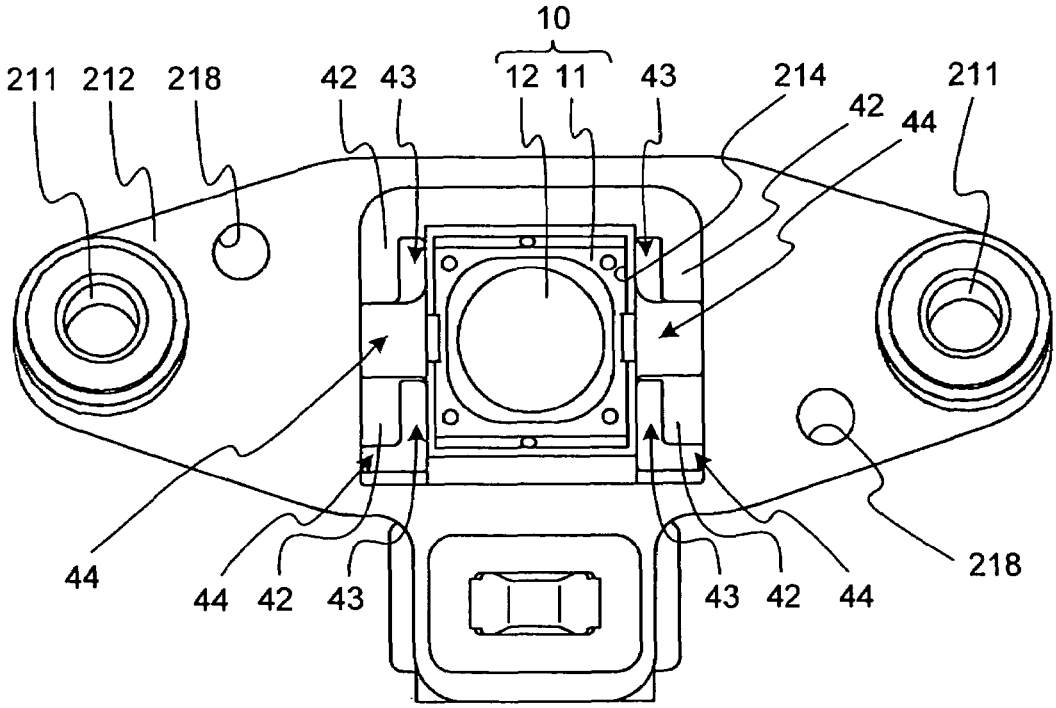
FIG. 2B is a plan view of the latch releasing device in which a key top member with a cover member shown in FIG. 2A is omitted.
Figure 3:
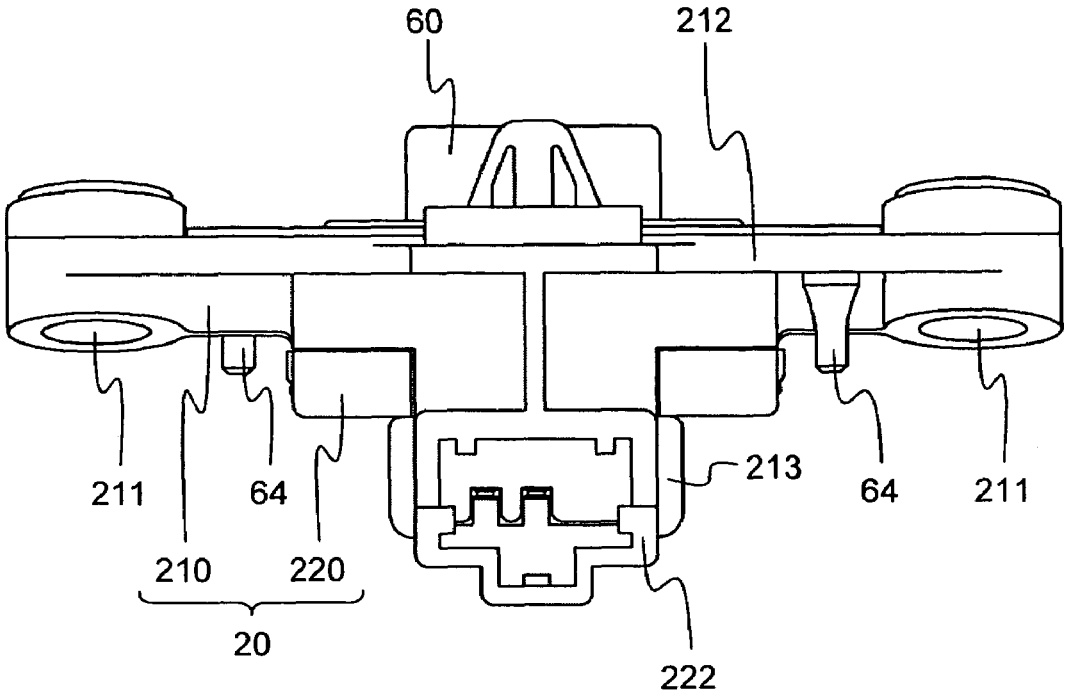
FIG. 3 is a schematic of the latch releasing device shown when viewed from a direction indicated by an arrow III in FIG. 2A.
Figure 4:
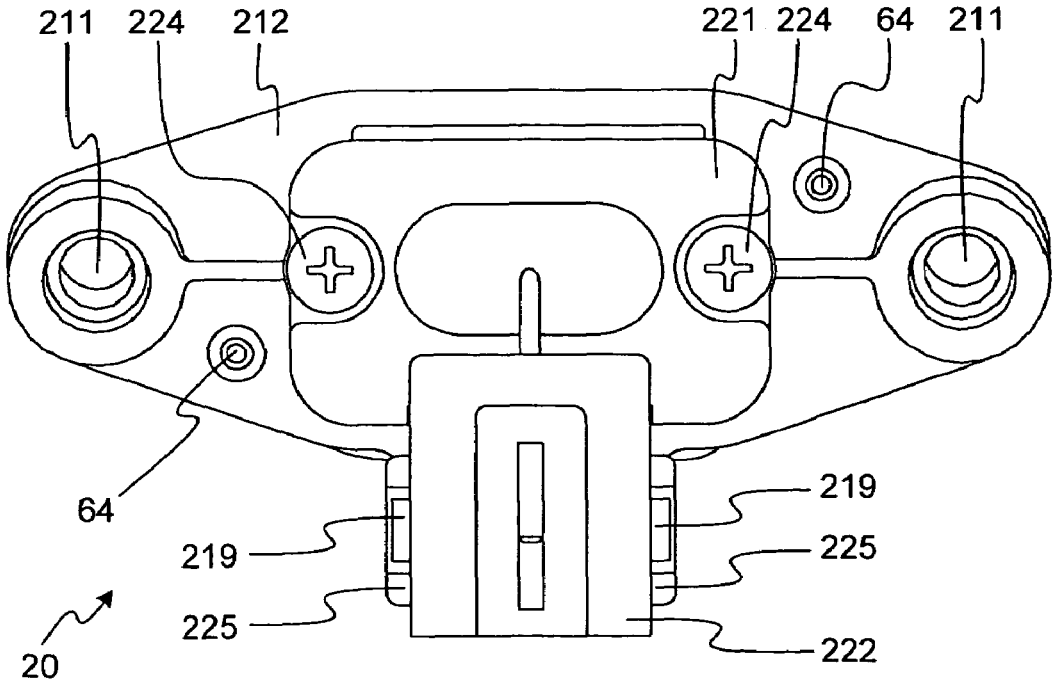
FIG. 4 is a schematic of a bottom surface of the latch releasing device.
Figure 5:
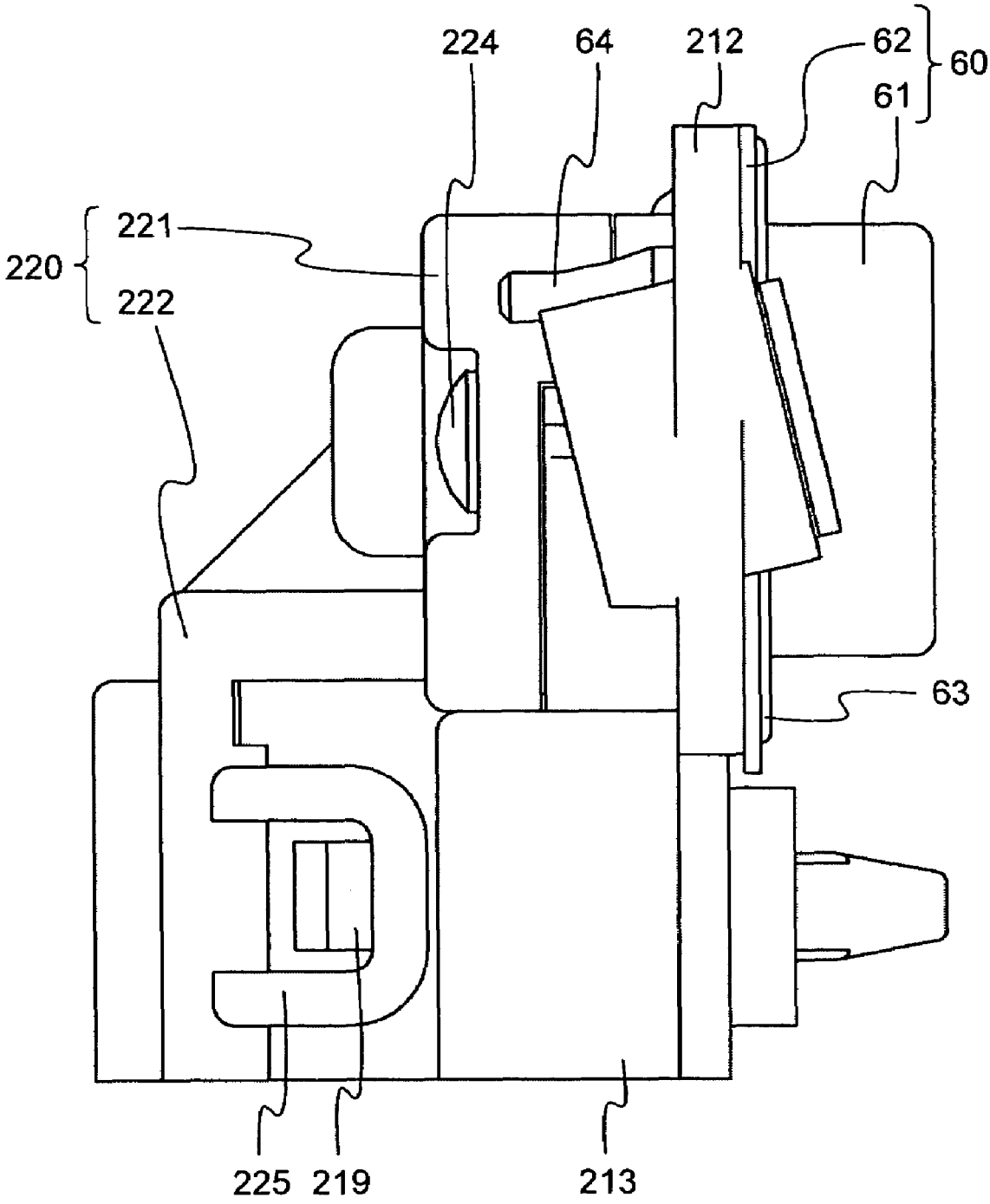
FIG. 5 is a lateral view of the latch releasing device.

As shown in FIGS. 2A and 2B, the switch 10 is a standardized component called tact switch, and includes a switch body 11 and a pressing button 12. The switch body 11 is externally shaped thin and substantially square. The thin cylindrical pressing button 12 projects from an upper surface of the switch body 11. In normal condition, the switch 10 stays off. When the pressing button 12 is pressed towards the switch body 11, the switch 10 is turned on. Upon releasing a pressing force on the pressing button 12, the pressing button 12 reverts to the original position by the operation of a return spring (not shown) inside the switch 10, and the switch 10 is turned off again.

The base member 20 is formed of a relatively hard and synthetic resin having electrical insulation property. As shown in FIGS. 1 to 9, the base member 20 includes a base body 210 and a cap 220 that are separate members.

The base body 210 includes a plate 212 with screw holes 211 at both the ends, and a main-body-side terminal box 213 that projects from an edge of the back surface of the plate 212. The plate 212 and the main-body-side terminal box 213 are integrally formed. The plate 212 includes a switch housing concave portion 214 at nearly the center of the front surface. The plate 212 also includes a biasing member housing portion 215 at a position of the back surface corresponding to the switch housing concave portion 214.

Vertical and horizontal dimensions of the switch housing concave portion 214 are a little greater than those of the switch body 11 of the switch 10. The switch housing concave portion 214 is a recess with a depth a little greater than the entire height of the switch 10 including the pressing button 12. The switch housing concave portion 214 houses the switch 10 such that the pressing button 12 faces the front side.

The biasing member housing portion 215 is a recess of rectangular shape having sufficiently greater vertical and horizontal dimensions than those of the switch housing concave portion 214. The biasing member housing portion 215 includes a pair of terminal pieces 216 and 217. The terminal pieces 216 and 217 are electrically conductive members that respectively include first members 216*a* and 217*a* extending along the back surface of the base body 210, second members 216*b* and 217*b* bent and extended from one end of the first members 216*a* and 217*a* at a substantially right angle in a direction departing from the base body 210, and third members 216*c* and 217*c* bent and extended from one end of the second members 216*b* and 217*b* at a substantially right angle in the main-body-side terminal box 213. Although not shown in the drawings, in the terminal pieces 216 and 217, the first members 216*a* and 217*a* are electrically connected to the terminals of the switch 10 by soldering.

A pair of cover fitting holes 218 is formed on the plate 212 of the base body 210. The cover fitting holes 218 are circular holes on the horizontal surface and formed on both sides of the biasing member housing portion 215 to penetrate the plate 212.

The cap 220 of the base member 20 includes a cover cap 221 and a cap-side terminal box 222 that are integrally formed. The cap 220 is detachably fixed to the base body 210. The cover cap 221 is of a size such that the biasing member housing portion 215 of the base body 210 can be covered. By fixing screws 224 engaged with screw insertion holes 223 formed on both sides of the cap 220, the cover cap 221 is fixed to the base body 210 such that the cover cap 221 covers the biasing member housing portion 215. When the cap-side terminal box 222 and the main-body-side terminal box 213 of the base body 210 are joined together, they form a terminal box with the third members 216*c* and 217*c* of the terminal pieces 216 and 217 inside it as terminals. Elastic engaging members 225 on both sides of the cap-side terminal box 222 engage with engaging projections 219 of the main-body-side terminal box 213 to fix the cap-side terminal box 222 to the main-body-side terminal box 213.

The latch releasing device also includes a key top member 30 on the front surface of the base body 210 in the base member 20. The key top member 30 is formed of relatively hard and synthetic resin. The key top member 30 is rectangular in shape with a bottom surface that is sufficiently greater than the pressing button 12 of the switch 10. An engaging member 40 and a slide controlling member 50 are formed on the key top member 30 between the key top member 30 and the base member 20, and a cover member 60 is formed to cover the surface of the key top member 30.

After the key top member 30 is brought near the base member 20, the engaging member 40 engages the key top member 30 and the base member 20 by sliding movement. The engaging member 40 includes a plurality of engaging pawls 41 formed on the periphery of the bottom surface of the key top member 30, and pawl locking portions 42 formed on the base body 210 of the base member 20.

Figure 1:
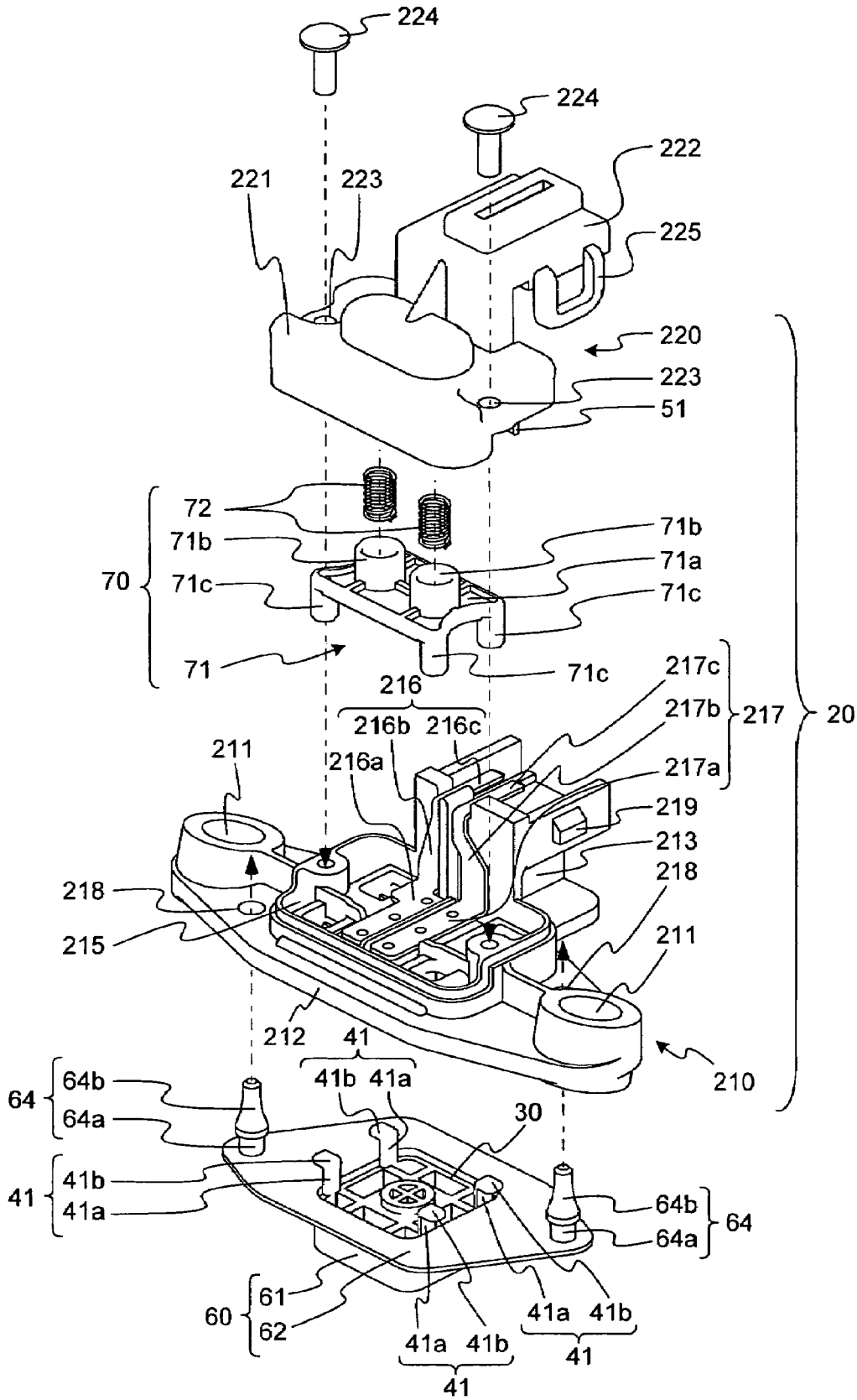
FIG. 1 is a schematic for explaining a concept of a latch releasing device according to an embodiment of the present invention.

As shown in FIG. 1, each of the engaging pawls 41 includes a pawl base 41*a* that projects downwards from the bottom surface of the key top member 30, and engaging portion 41*b* that bends at a right angle from the projecting edge of the pawl base 41*a* towards external peripheral direction of the key top member 30. In the embodiment, there are a total of four engaging pawls 41 arranged in two positions at both left and right ends of the key top member 30. The four engaging pawls are mirror symmetrical with respect to the surface that bisects the key top member 30 into left and right halves, and are mirror symmetrical with respect to the surface that bisects the key top member 30 into front and rear halves.

As shown in FIG. 2B, the pawl locking portions 42 are fringe-like projections on both sides of the switch housing concave portion 214 in the base body 210 of the base member 20, and formed correspondingly to the respective engaging pawls 41. Between the pawl locking portions 42 and the switch housing concave portion 214 in the base member 20 are arranged sliding grooves 43 each having a width that allows the insertion of the pawl base 41*a* of the engaging pawl 41. Further, an insertion hole 44, having a size that allows the insertion of the engaging portions 41*b* of the engaging pawls 41, extends continuously from the edge of the sliding groove 43. A mutual distance between the sliding grooves 43 is equal to a mutual distance between the pawl bases 41*a* of the engaging pawls 41 at both ends of the key top member 30.

Figure 6:
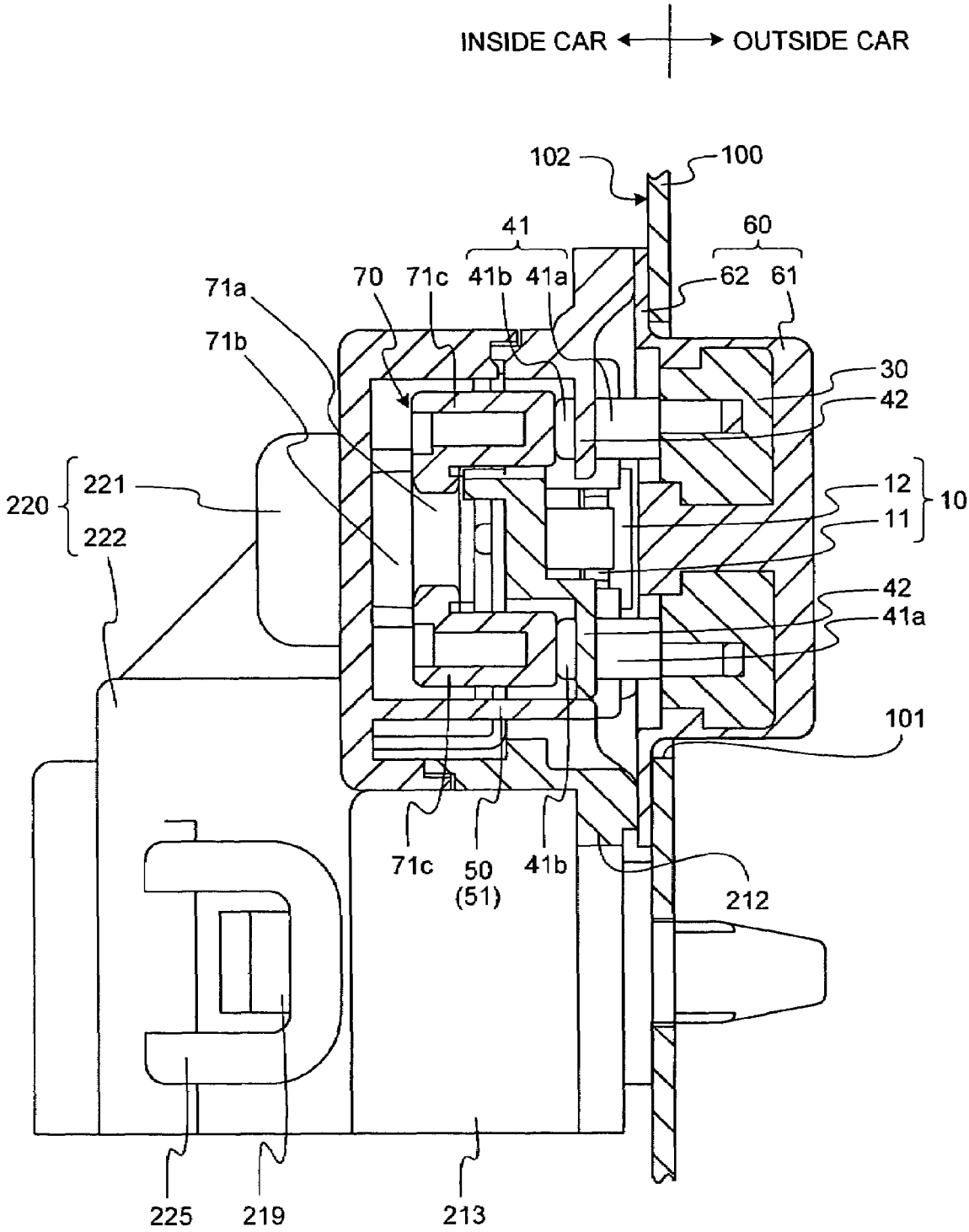
FIG. 6 is a lateral cross section of part of the latch releasing device.
Figure 7:
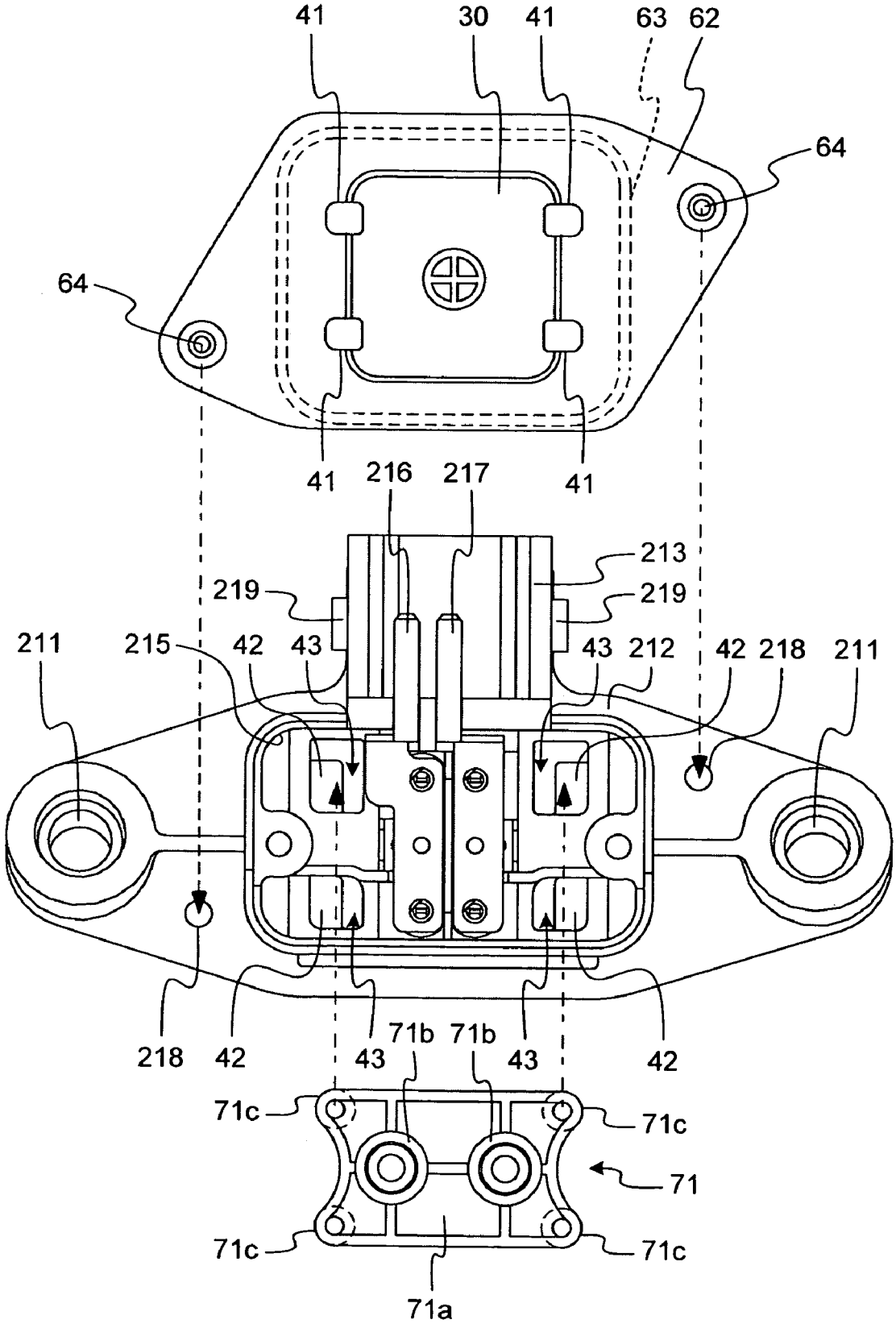
FIG. 7 is a schematic of a disassembled bottom surface of the latch releasing device in which a cap of a base member is omitted.
Figure 8:
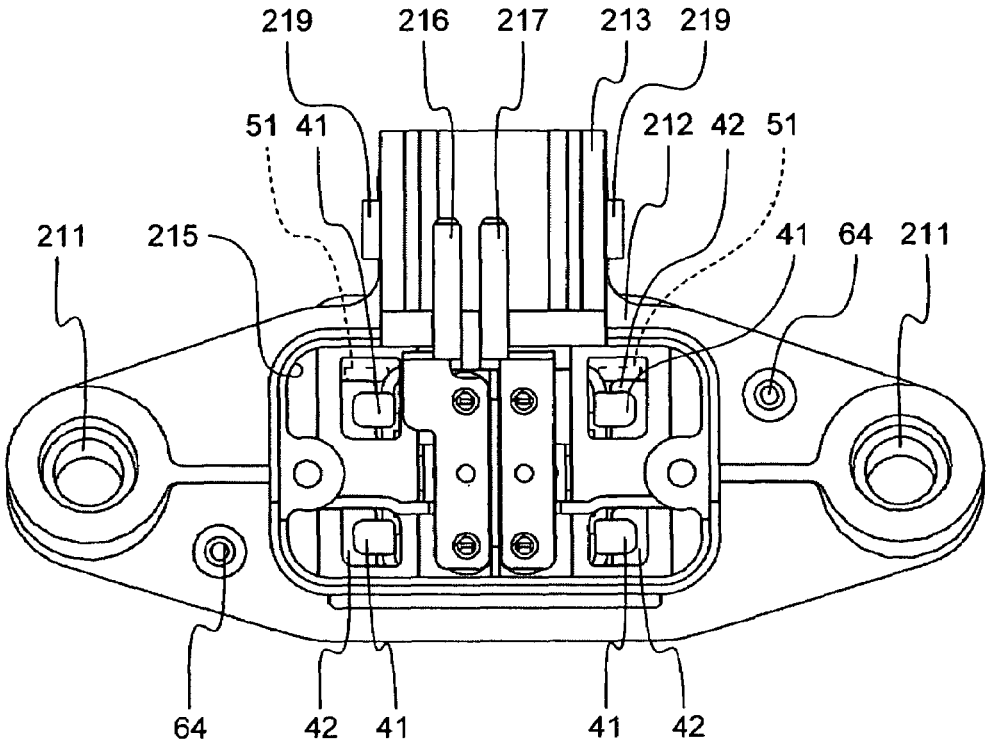
FIG. 8 is a schematic of the latch releasing device shown in FIG. 7 when the key top member is fixed to a base body of the base member.
Figure 9:
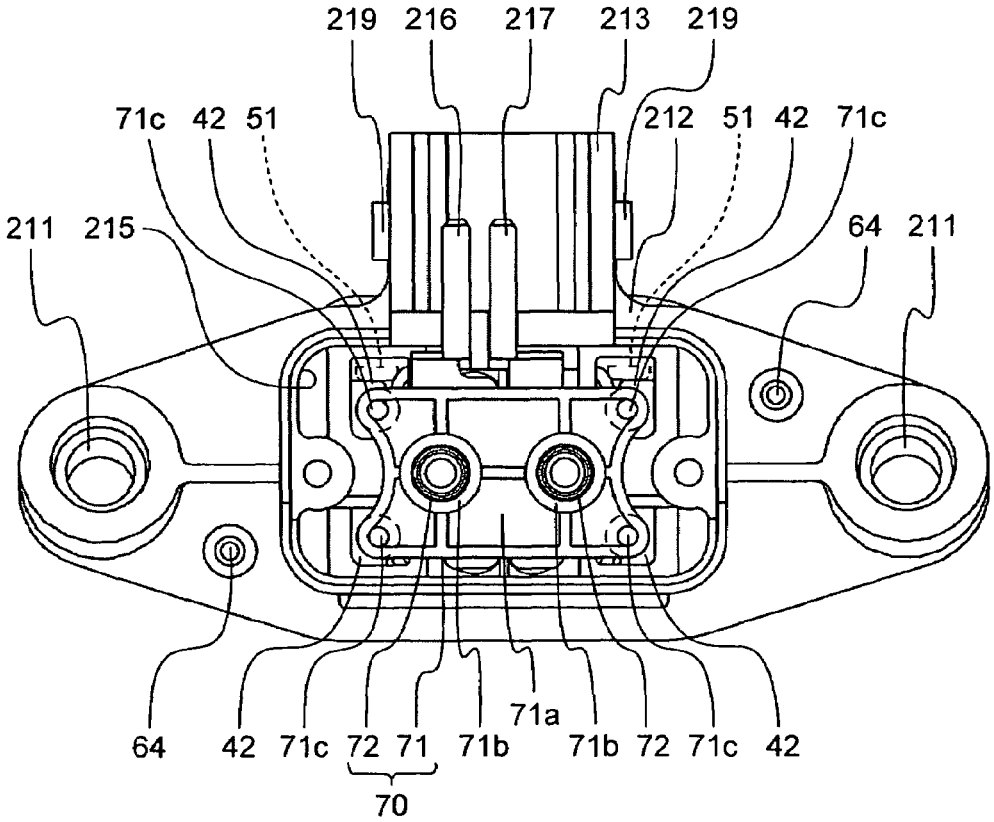
FIG. 9 is a schematic of the latch releasing device shown in FIG. 8 when a biasing member is fixed to the base body of the base member.
Figure 10:
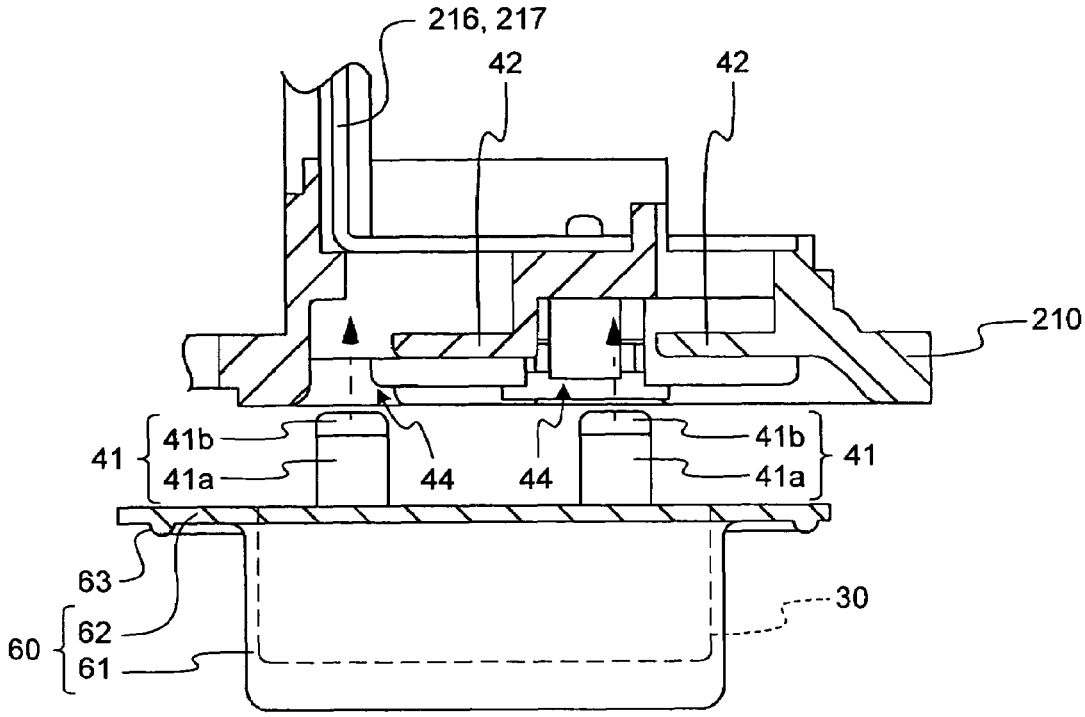
FIG. 10 is a cross section of part of the latch releasing device when the key top member is fixed to the base body of the base member.
Figure 11:
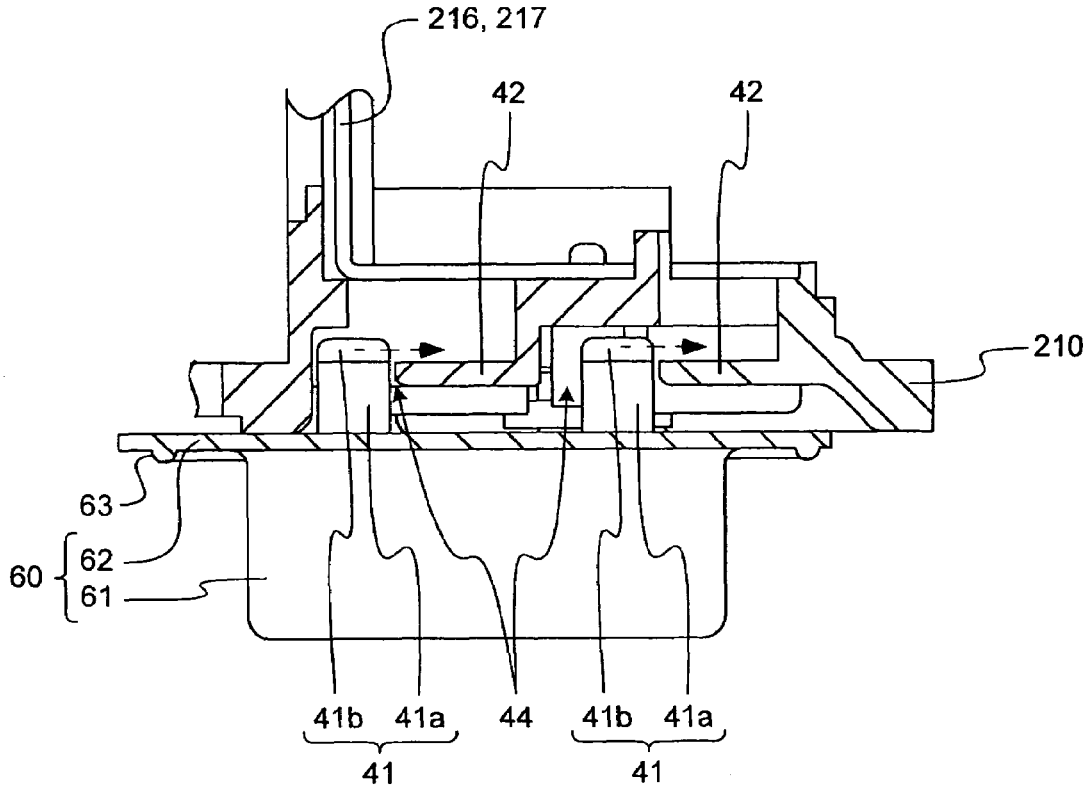
FIG. 11 is another cross section of part of the latch releasing device when the key top member is fixed to the base body of the base member.
Figure 12:
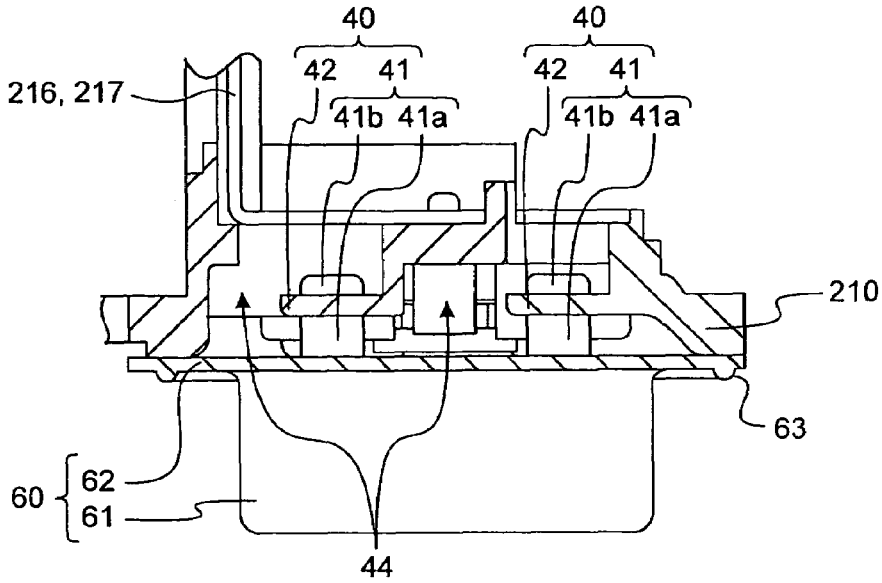
FIG. 12 is yet another cross section of part of the latch releasing device when the key top member is fixed to the base body of the base member.

As shown sequentially in FIG. 10 to FIG. 12, after the respective engaging pawls 41 of the key top member 30 are brought to face the corresponding insertion holes 44 of the base body 210, the key top member 30 is brought near the base body 210 and made to slide along the sliding grooves 43 while the engaging portions 41*b* of the engaging pawls 41 have passed through the pawl locking portions 42. Then, the engaging portions 41*b* of the engaging pawls 41 come into contact with the pawl locking portions 42 with the central portion of the key top member 30 facing the pressing button 12 of the switch 10, and dropping out of the key top member 30 from the base body 210 is prevented. As shown in FIG. 6, although a marginal space is secured between the bottom surface of the key top member 30 and the pressing button 12 of the switch 10, pressing the key top member 30 can turn on the switch 10.

Figure 13:
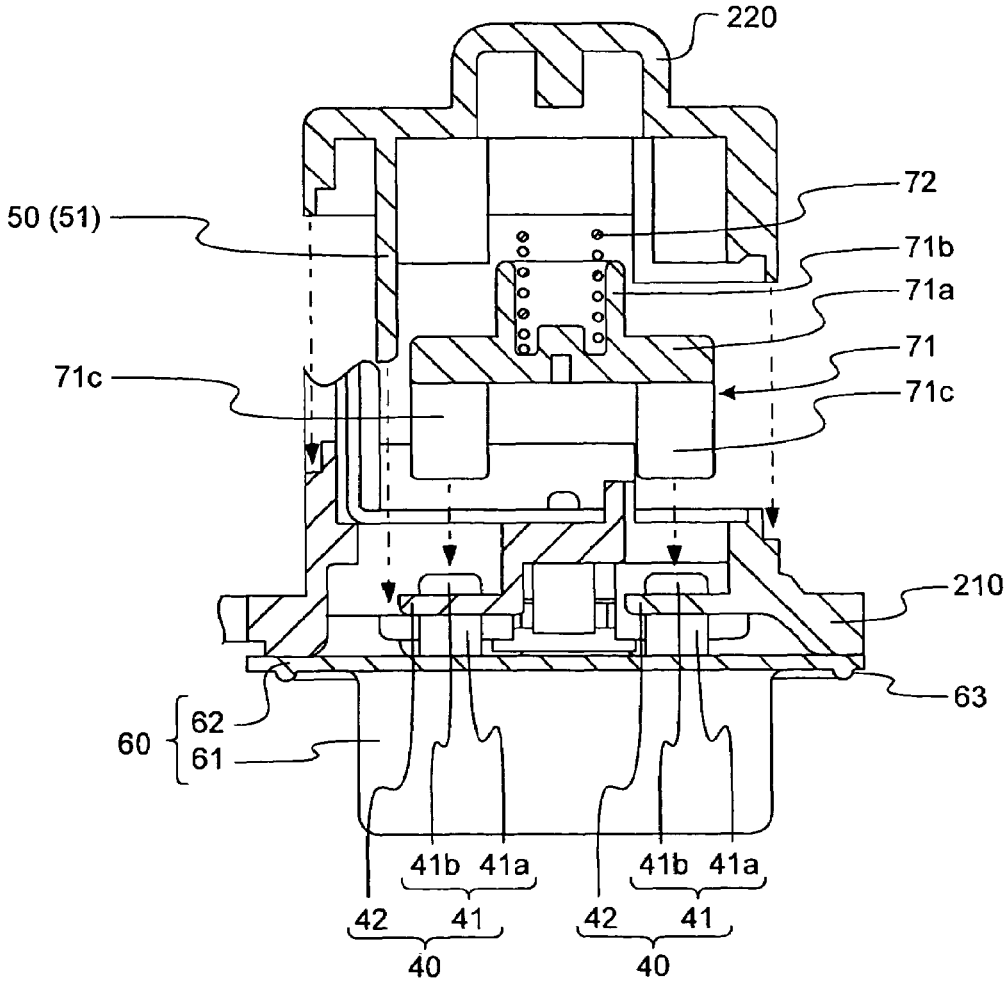
FIG. 13 is a cross section of the part of the latch releasing device shown in FIG. 12 when the biasing member and the cap are fixed to the base body of the base member.

The slide controlling member 50 controls the sliding movement of the key top member 30 with respect to the base member 20 when the engaging portions 41*b* of the engaging pawls 41 and the pawl locking portions 42 have come in contact. The slide controlling member 50 in the embodiment includes a pair of slide controlling members 51 formed on the cap 220 of the base member 20. As shown in FIG. 13, the slide controlling member 51 is a tongue-like portion that projects from the cover cap 221 of the cap 220 towards the base body 210. When the cap 220 is fit on the base body 210, the projecting edge of the slide controlling member 51 is positioned at the edge of the corresponding pawl locking portion 42, and prevents the engaging portion 41*b* of the engaging pawl 41 contact-engaging with the pawl locking portion 42 from reaching the insertion hole 44. If the cap 220 is removed from the base body 210, the key top member 30 is slid against the base body 210, and the engaging portions 41*b* of the engaging pawls 41 are positioned at the insertion holes 44. Thus, the key top member 30 can be removed from the base body 210.

As shown in FIGS. 1 to 9, the cover member 60 is waterproof. The cover member 60 is formed of relatively highly elastic material such as ethylene propylene diene rubber, and includes a key cover 61 and a base cover 62. The key cover 61 covers the upper surface and four side surfaces of the key top member 30, and is fitted not to be easily separated from the upper surface and the side surfaces of the key top member 30. The base cover 62 is a thin film shaped portion that extends flat from an opening periphery of the key cover 61 in an outward direction. The size of the base cover 62 is sufficiently large to cover a central portion including a pair of cover fitting holes 218 on the surface of the base body 210 in the base member 20.

The base cover 62 includes a pressure-deformable portion 63 in a position that is opposed to the flat surface of the base body 210. Fitting projections 64 are formed integrally with the base cover 62 in positions corresponding to the cover fitting holes 218.

The pressure-deformable portion 63 is a narrow thick portion that projects from the surface of the base cover 62. The non-edged pressure-deformable portion 63 is formed in the outer peripheral area of the key cover 61.

Each of the fitting projections 64 includes an axis 64*a* having a circular transverse surface, and a retaining member 64*b*. The retaining member 64*b* is bulged at the tip of the axis 64*a* in a diametrically outward direction, and tapered towards the tip. Outer diameter of the axis 64*a* is a little greater than an inner diameter of the cover fitting hole 218 on the base body 210. The outer diameter of the tip of the retaining member 64*b* is a little less than the inner diameter of the cover fitting hole 218, while the outer diameter of the base portion of the retaining member 64*b* is greater than the inner diameter of the cover fitting hole 218. After the engaging pawls 41 of the key top member 30 are engaged with the pawl locking portions 42, the fitting projections 64 are inserted into the cover fitting holes 218 while the retaining members 64*b* are elastically deformed, and the base portions of the retaining members 64*b* are positioned on the back surface of the base body 210. If the fitting projections 64 are held in such a condition, each retaining member 64*b*, whose outer diameter at the base portion has reverted to the original condition due to elastic resilience, comes in contact with the back surface of the base body 210. Thus, accidental dropout of the cover member 60 from the base member 20 can be prevented. If the retaining members 64*b* are bent and pulled out from the cover fitting holes 218, the fitting projections 64 can be removed from the base body 210.

Further, the latch releasing device includes a biasing member 70 in a space between the biasing member housing portion 215 of the base body 210 in the base member 20 and the cover cap 221 of the cap 220. The biasing member 70 biases the key top member 30 in a direction departing from the pressing button 12 of the switch 10. In the embodiment, the biasing member 70 includes a tension plate 71 and a pair of coil springs 72.

The tension plate 71 is formed of a relatively hard and synthetic resin. The tension plate 71 includes a pair of spring housing portions 71*b* on one surface of a plate shaped base 71*a*, and four legs 71*c* on the other surface of the base 71*a*. The cylindrical spring housing portions 71*b* are arranged in parallel to each other such that central axis of the spring housing portions 71*b* is perpendicular to one surface of the base 71*a*. The column shaped legs 71*c* extending from the base 71*a* are arranged at four corners of the base 71*a* such that apical surfaces of all the legs 71*c* can simultaneously come in contact with the engaging portions 41*b* of the engaging pawls 41 on the key top member 30. The size of the transverse surface of the legs 71*c* nearly matches the size of the engaging portions 41*b* of the engaging pawls 41 on the key top member 30. The length of the legs 71*c* is predetermined such that a predetermined space is secured between the base 71*a* and the first members 216*a* and 217*a* of the terminal pieces 216 and 217, respectively, when the apical surfaces of the legs 71*c* come in contact with the pawl locking portions 42 from the back surface of the base body 210, and a space is secured sufficiently for the stroke amount when the key top member 30 is pressed between the cap 220 fitted on the base body 210 and the spring housing portions 71*b*.

The spring housing portions 71*b* and the legs 71*c* are mirror symmetrical with respect to the surface that bisects the tension plate 71 into left and right halves, and are mirror symmetrical with respect to the surface that bisects the tension plate 71 into front and rear halves.

The pair of coil springs 72 has such an external diameter that the coil springs 72 can be housed in the spring housing portions 71*b* of the tension plate 71. When the cap 220 is fitted to the base body 210, the pair of coil springs 72 is interposed between the base body 210 and the cap 220 in a compressed condition to constantly press the legs 71*c* of the tension plate 71 against the engaging pawls 41 of the key top member 30. A spring constant of the pair of coil springs 72 is set to be greater than a spring constant of a return spring (not shown) inside the switch 10 to ensure that a force to bring the tension plate 71 near the cap 220 is greater than a force to press the pressing button 12.

As shown in FIG. 6, in the latch releasing device as above, the key top member 30 covered by the cover member 60 faces outside from an opening 101. The base member 20 is arranged on an inner surface 102 of a door panel 100 such that the pressure-deformable portion 63 of the cover member 60 is sandwiched between the surface of the base body 210 in the base member 20 and the inner surface 102 of the door panel 100. The base member 20 is fixed to the trunk lid by fixing screws (not shown) to the door panel 100 via the screw holes 211 of the base body 210.

In the fixed condition, the cover member 60 covers the entire surfaces of the key top member 30 and the base member 20. Further, the pressure-deformable portion 63, which is pressed and sandwiched between the surface of the base body 210 in the base member 20 and the inner surface 102 of the door panel 100, functions as a sealing material. Thus, rainwater or washing water cannot enter inside the trunk via the opening 101 of the door panel 100.

Moreover, due to pressing force of the pair of coil springs 72, the key top member 30 is held at a position spaced apart from the pressing button 12 of the switch 10 via the tension plate 71. Thus, the switch 10 is maintained off.

Figure 14A:
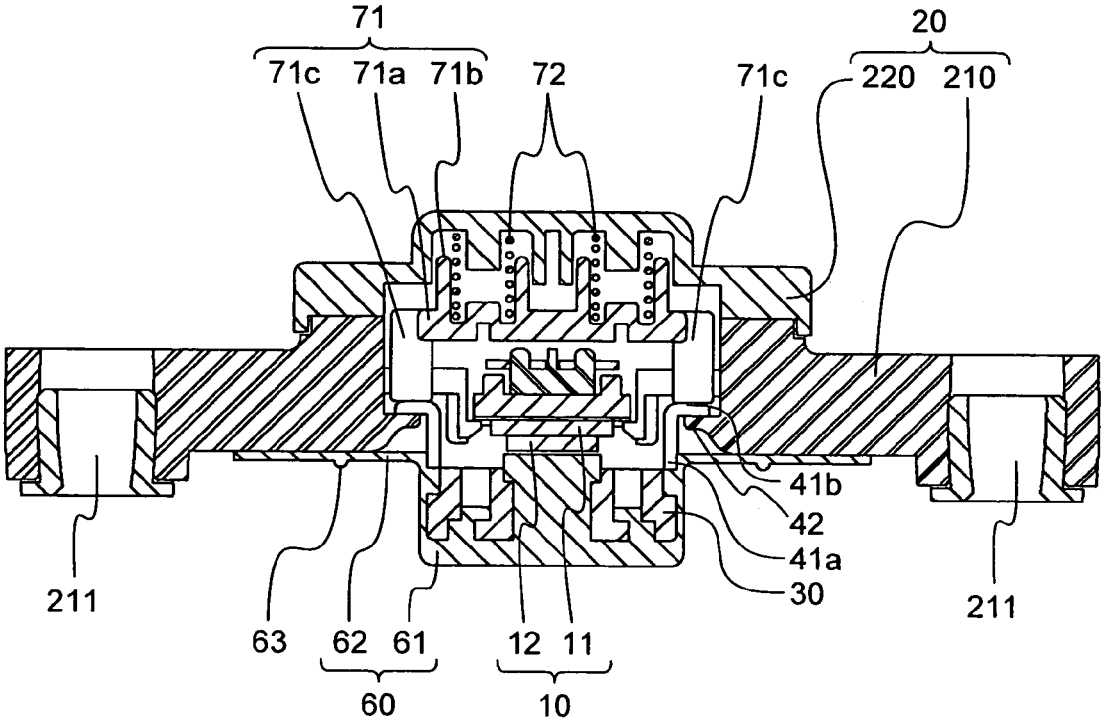
FIG. 14A is a cross section of the latch releasing device when a switch shown in FIGS. 2A and 2B is off.
Figure 14B:
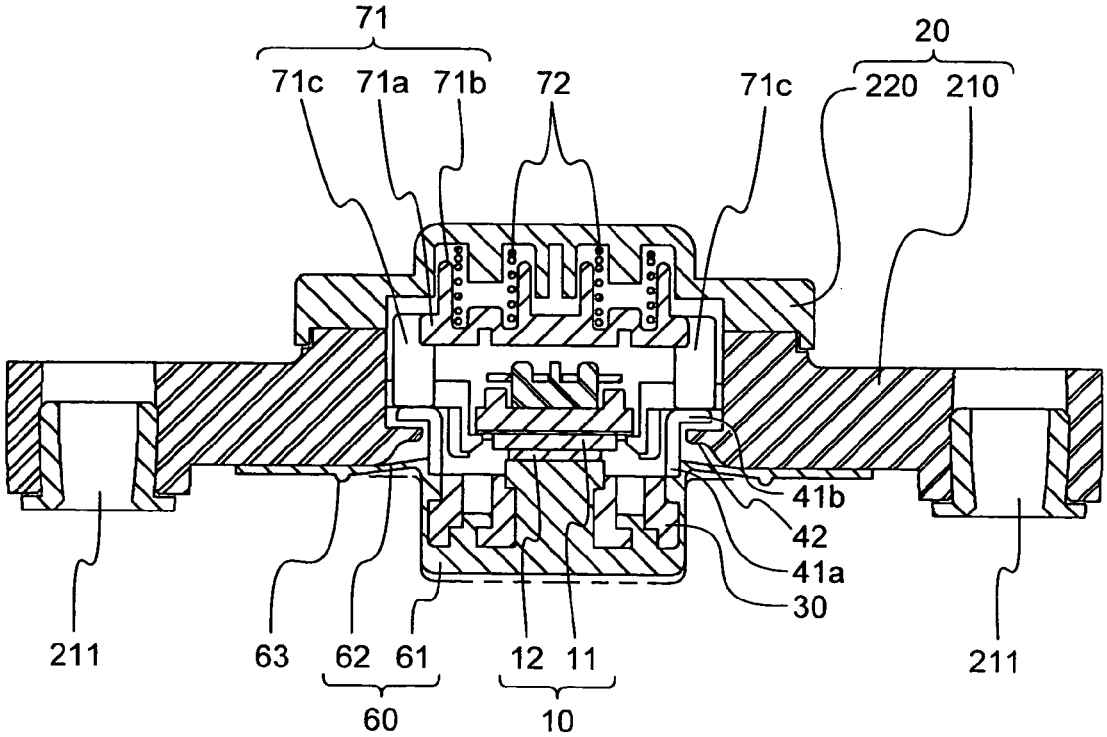

As shown in FIGS. 14A and 14B, in the fixed condition as above, if the key top member 30 is pressed from outside of the door panel 100, the pressing button 12 of the switch 10 is pressed via the bottom surface of the key top member 30, and the switch 10 is turned on. Thus, if a desired cable is connected to the terminal pieces 216 and 217 via the terminal box such that the switch 10 functions as an activation switch of a release actuator, pressing of the switch 10 drives the release actuator and the latched condition of the trunk lid can be released.

In the latch releasing device, because the biasing member 70 is interposed between the key top member 30 and the cap 220 of the base member 20, a spring force of the pair of coil springs 72 needs to be overcome for pressing the pressing button 12 of the switch 10 by pressing the key top member 30. Thus, for example, even if washing water having a high pressure is sprayed on the key top member 30 via the cover member 60 at a car washing station, the pressing button 12 of the switch 10 does not malfunction due to pressing, and accidental opening of the trunk lid can be effectively prevented.

Further, malfunctioning of the switch 10 is prevented without increasing the spring constant of the return spring (not shown) inside the switch 10. Thus, simply pressing the key top member 30 can reliably turn on the switch 10. Due to this, occurrence of a defect such as that the switch 10 is not turned on by pressing the key top member 30 is prevented, and a significant reduction in the operability is also prevented.

Furthermore, when the engaging portions 41*b* of the engaging pawls 41 are engaged with the pawl locking portions 42, sliding movement of the key top member 30 with respect to the base member 20 and also sliding movement of the tension plate 71 with respect to the base member 20 can be controlled by the pair of the slide controlling members 51. Thus, engaged condition of the legs 71*c* of the tension plate 71 and the engaging pawls 41 of the key top member 30 is not released accidentally, and the aforementioned effect can be continuously ensured.

After the switch 10 is turned on, if the pressing force of the key top member 30 is removed, the key top member 30 reverts to the original position due to the pressing force of the coil springs 72 via the tension plate 71, the pressing button 12 reverts back to the original position due to the return spring (not shown) of the switch 10, and the switch 10 is turned off.

Incidentally, in the embodiment described above, the latch releasing device is applied to the trunk lid for opening and closing the trunk of a vehicle such as a four-wheeled car. However, the present invention is not to be thus limited, and can also be applied to release latched condition of other doors.

In the embodiment, the switch 10 includes the switch body 11 being thin and substantially square, and the thin cylindrical pressing button 12 that projects from the upper surface of the switch body 11. However, the shape and the structure of the switch are cited merely by way of example and without limitation.

As described above, according to an embodiment of the present invention, a biasing member is interposed between a base member and a key top member to bias the key top member in a direction departing from a pressing button of a switch. Thus, for example, even if washing water having a high pressure is sprayed on the key top member, malfunctioning of the switch, such as that the switch is turned on, can be prevented. Moreover, because malfunctioning of the switch is prevented without increasing a spring constant of a return spring inside the switch, a significant reduction in the operability is also prevented.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A latch releasing device configured to latch or unlatch a door, the latch releasing device comprising:

a switch that turns on when pressed to unlatch the door;

a base member that holds the switch on a surface thereof;

a key top member that at least partially encloses the switch; and a biasing member that biases the key top member in a direction departing from the switch, wherein the switch is fixed to a panel via the base member such that the switch can be pressed from outside the panel via the key top member, and the biasing member includes:

a tension plate that comes in contact with the key top member; and a pressing spring that presses the tension plate against the key top member, wherein in response to a press on the key top member, the tension plate moves against a pressing force of the pressing springs.

2. The latch releasing device according to claim 1, further comprising a waterproof cover that covers the key top member, and includes a periphery being pressed and held between the panel and the base member.

3. The latch releasing device according to claim 1, wherein the key top member is formed of a hard material on the base member, and is larger than the switch, a central portion of the key top member facing the switch, and the biasing member operates between a periphery of the key top member and the base member.

4. The latch releasing device according to claim 1, further comprising, between the key top member and the base member:

an engaging member that engages the key top member and the base member with mutual sliding movement between the key top member and the base member to allow the key top member to be pressed with respect to the base member, and restricts dropping of the key top member from the base member; and a slide controlling member that controls, after the key top member is engaged with the base member by the engaging member, sliding movement of the key top member with respect to the base member.

5. The latch releasing device according to claim 4, wherein the base member includes a base body that holds the switch, with the engaging member between the key top member and the base body; and a cap that is detachably arranged on the base body, and operates, upon being fitted to the base body after the key top member is engaged with the base member, the slide controlling member to control the sliding movement of the key top member with respect to the base member.

* * * * *